US005979572A

United States Patent [19]

Boyd et al.

[11] Patent Number: 5,979,572

[45] Date of Patent: Nov. 9, 1999

[54] FLOW CONTROL TOOL

[75] Inventors: Mark Boyd, Norwich; Mark Stanley Davy, Framlingham, both of United Kingdom

[73] Assignee: UWG Limited, Norwich, United Kingdom

[21] Appl. No.: 08/930,423

[22] PCT Filed: Mar. 20, 1996

[86] PCT No.: PCT/GB96/00667

§ 371 Date: Sep. 23, 1997

§ 102(e) Date: Sep. 23, 1997

[87] PCT Pub. No.: WO96/30621

PCT Pub. Date: Oct. 3, 1996

[30] Foreign Application Priority Data

Mar. 24, 1995 [GB] United Kingdom ..... 95 05998

[51] Int. Cl.[6] ..... E21B 4/02

[52] U.S. Cl. ..... 175/107; 175/243; 175/318

[58] Field of Search ..... 175/107, 232, 175/243, 317, 318; 166/334.1, 334.4, 240

[56] References Cited

U.S. PATENT DOCUMENTS

| | | | |
|---|---|---|---|
| 3,025,919 | 3/1962 | Angel et al. | 175/317 |
| 3,901,333 | 8/1975 | Mori | 175/318 |
| 4,298,077 | 11/1981 | Emery | 175/317 |
| 5,174,392 | 12/1992 | Reinhardt | 175/317 |
| 5,730,222 | 3/1998 | Rike, Jr. | 175/317 |

*Primary Examiner*—William Neuder

*Attorney, Agent, or Firm*—Renner, Kenner Greive, Bobak, Taylor & Weber

[57] ABSTRACT

A tool for incorporation in a drill string has an outer body (11, 12, 13) and a spool (17, 18, 19) rotationally and slidably mounted within the body. A cam groove (20) is formed on camming component (17) of the spool and interacts with pins (21) to cause uni-directional spool rotation through a number of pre-set angular positions as the spool is reciprocated. The valving component (18) of the spool is closed internally by wall (26) and has orifices (25) which come into and out of registration with body openings (29) as the spool is moved through its pre-set positions. When in registration, flow into the tool will leave the tool radially outwardly through openings (29); but when out of registration, the flow will be into chamber (28) of body central component (12), and back into the valving component (18) downstream of wall (26) through apertures (27).

18 Claims, 4 Drawing Sheets

FLOW CONTROL TOOL

This invention relates to a flow control tool for incorporation in an underground string.

The exploration for and production of oil and gas from underground locations requires the drilling of an elongate bore to an underground reservoir. To achieve this, a driven cutting bit is positioned at the leading end of an elongate drilling tube made up from lengths of pipe connected end-to-end, which drilling tube is referred to in the art as a drill string. As the bore is drilled, it is lined with a casing and subsequently, following withdrawal of the drill string, a further tube is inserted into that casing which further tube is also made up from lengths of pipe connected end-to-end. This further tube is referred to in the art as a production string.

Drilling is performed by pumping a liquid (usually referred to as "mud") along the drill string to cause rotation of the drill bit, to cool and lubricate the drill bit, and to clean cuttings out of the drilled bore. An hydraulic motor driving the cutting bit is located at the forward end of the drill string, upstream of the cutting bit, and is operated by the mud pumped from the surface down the string. Upstream of the motor, there is usually located telemetry equipment (known as an MWD unit), powered by a generator driven by the pumped mud and feeding signals back to the surface, concerning various parameters relating to the drilling.

After a period of drilling, it may be necessary to circulate liquid for example to obtain samples of cuttings, thereby to determine the nature of the formation being cut. To achieve this, mud is pumped down the drill string, returning cuttings back to the surface. The life of both the generator for the telemetry equipment and the hydraulic motor for the cutting bits depends upon the operational circulating time and so it is desirable to cease operation of both of these, other than when actual drilling is to be performed. There is therefore a need for a by-pass valve arrangement in the drill string upstream of the hydraulic motor and telemetry equipment, whereby operation of both may be suspended other than when actual drilling is taking place.

In some circumstances, there is a need for a by-pass valve which allows dual flow, wherein part of the flow is circulated, by-passing the hydraulic motor and telemetry equipment, with a reduced flow through the valve to the motor and so on. This has the advantage that the motor will still rotate but at a lower rate in view of the reduced flow, so reducing the likelihood of the bit becoming stuck in the bare hole.

After drilling has been completed, but before production is commenced, there is a cased-hole clean-out phase which may employ a principal string of one diameter and at the far end thereof a further, short string of a smaller diameter. Whilst cleaning the main casing, it is advantageous to use very high flow rates for the clean-out fluid, but the presence of the further short string restricts that to some extent, due to friction pressure losses. It would therefore be advantageous for the clean-out fluid flow to by-pass the further short string until the lowermost part of the bore is to be cleaned out by that string.

There have been various proposals for so-called circulating tools for incorporation in a string, to allow fluid pumped from the surface to issue through the string wall in the region of the tool and so to by-pass equipment downstream of the tool, or to constrain that fluid to continue along the string from the tool. In one such proposal, a valve is operated by dropping into the string a weight which is carried by the fluid flow to the tool and which then changes the state of the valve. Such a tool may be operated only a limited number of times, and typically three or four.

Another proposal is to provide a tool which is operated by axial pressure thereon, caused by the weight of the string above the tool. However, this can subject equipment downstream of the tool to high axial loads and moreover often cannot be used in the case of a bore extending significantly out of vertical. Yet another proposal is to be found in U.S. Pat. No. 4,298,077. In this, the repeated application and removal fluid pressure may sequentially move a valve member between one position where there can be no recirculating flow to another position where parallel flow paths, both for recirculating flow and through the motor, are possible. Though this may extend the life for example of a down-hole motor, the high pressures usually applied for example with clean-out fluid ensures that there will still be some flow through the motor during all operations, so shortening the useful operational life thereof.

The present invention aims at providing a circulating tool suitable for incorporation in an underground string and which may be operated between two different states an indefinite number of times, selectively when required.

According to the present invention, there is provided a flow control tool for incorporation in an underground string, comprising an elongate hollow outer body, a hollow inner spool mounted within the outer body and movable both axially and rotationally with respect thereto, motion control means arranged between the body and the spool to effect rotation of the spool relative to the body sequentially through a plurality of pre-set angularly spaced positions upon axial reciprocation of the spool, at least one spool orifice extending through a side wall thereof and which comes into communication with an opening through the body at a first pre-set position of the spool and is out of communication at a second pre-set position, spring means urging the spool in the axial direction opposed to the pumped fluid flow direction to a third pre-set position where flow through the spool is closed off, and the spool being arranged such that fluid under pressure and flowing axially therethrough moves the spool axially against the action of the spring.

It will be appreciated that in the present invention, the tool is actuated by relieving the pressure of the fluid pumped along the string, so allowing the spool to be moved under the action of the spring means, in the axial direction against the fluid flow. The motion control means causes the spool to turn relative to the body, whereby on subsequently pumping fluid along the string, the spool orifice will be in communication with the body opening, or will be out of communication with the body opening, depending upon the state of the tool prior to relieving the pressure. Conveniently, the spool orifice and body opening come into communication by direct registration therebetween, when the spool is in a first pre-set position.

Preferably, the motion control means comprises a cam surface on one of the spool and the body, and a cam follower on the other of the spool and the body. Conveniently, the cam surface is on a cylindrical surface of the spool and comprises a camming groove in which is located a pin on a confronting surface of the body. The motion control means may effect uni-directional rotation of the spool with respect to the body upon reciprocation of the spool and may define at least one first pre-set position and at least one second pre-set position, spaced both axially and angularly from each other. Advantageously, there are two first and two second pre-set positions, arranged alternately, though there could be other numbers of such pre-set positions.

In a preferred embodiment, the spool is disposed nearer the downstream end of a string to which the tool is coupled, when in its second pre-set position. To allow flow then to continue through the tool, the spool may have an internal dividing wall downstream of the or each orifice therein, and at least one flow re-entry aperture leading to the interior of the spool downstream of said wall, the body defining an internal chamber with which both the or each spool orifice and the or each spool aperture communicate when the spool is in a second pre-set position. In this way, the flow will be through the spool orifice to enter the body chamber, and then back into the spool downstream of said dividing wall through the re-entry aperture, to continue down the spool and then axially out of the body. Conversely, when the spool is in its first pre-set position, the dividing wall prevents flow continuing along the spool so that all flow will pass out of the tool through the or each registering spool orifice and body opening.

In a modified form of the tool as described, flow passages may be provided to permit partial flow through the tool and partial outward flow through a communicating spool orifice and body opening, when the spool is set to the first pre-set position.

The axially opposed ends of the body may be provided with any conventional form of string coupler, to allow the body to form a part of the string itself. Thus, the body should have an external diameter not greater than the external diameter of the pipe connections making up the string.

By way of example only, one specific embodiment of circulating tool of this invention will now be described in detail, reference being made to the accompanying drawings, in which:

FIGS. 1A and 1B together are a sectional view through the tool in a through-flow (second) pre-set position, line X—X marked on both Figures lying in a common plane;

Figure 1A:
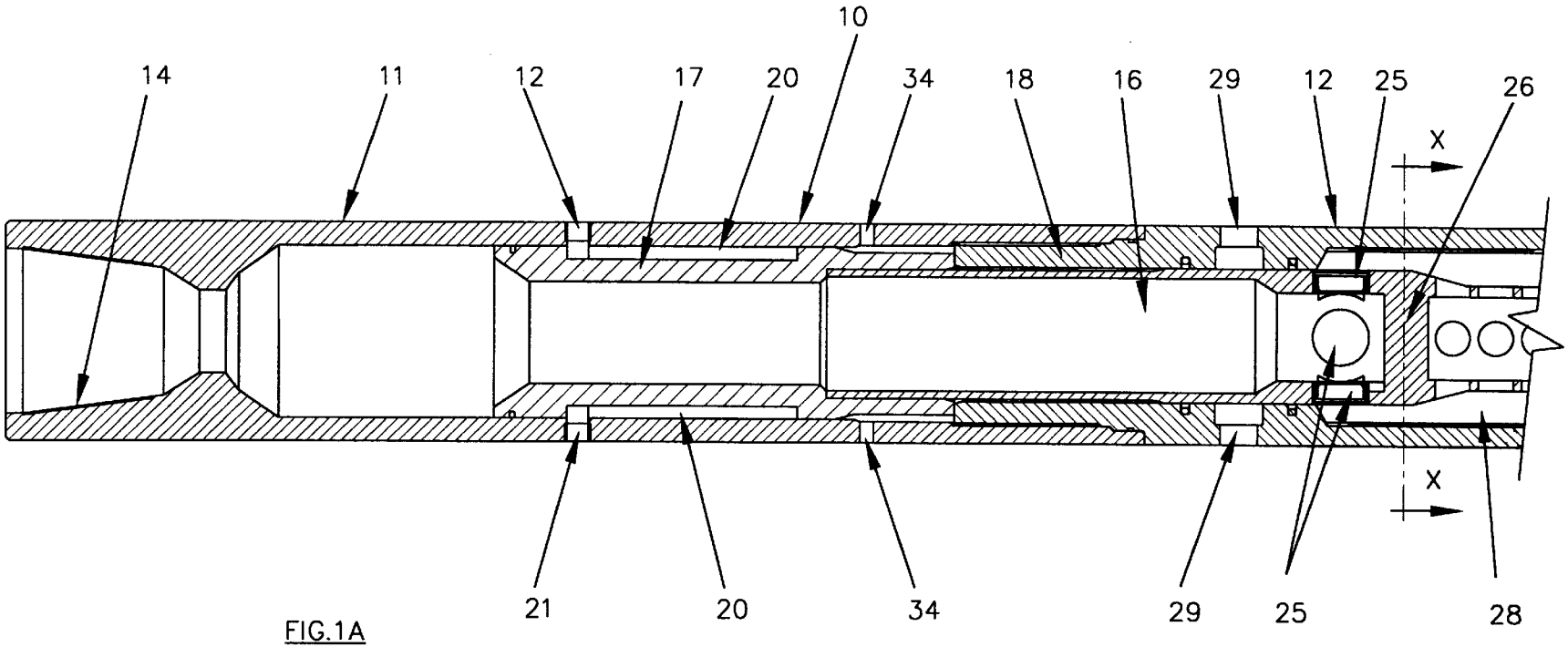

The tool shown in the drawings comprises a cylindrical body 10 made up from upstream, central and downstream components 11, 12 and 13 rigidly and sealingly connected end-to-end. The free ends of the upstream and downstream components 11 and 13 are formed with female and male string couplers 14 and 15 respectively, to allow the body to be connected into and form a part of a drill string. Slidably and rotationally mounted within the body 10 is a spool 16, constructed from camming, valving and forward components 17, 18 and 19 rigidly and sealing connected end-to-end.

Figure 1B:
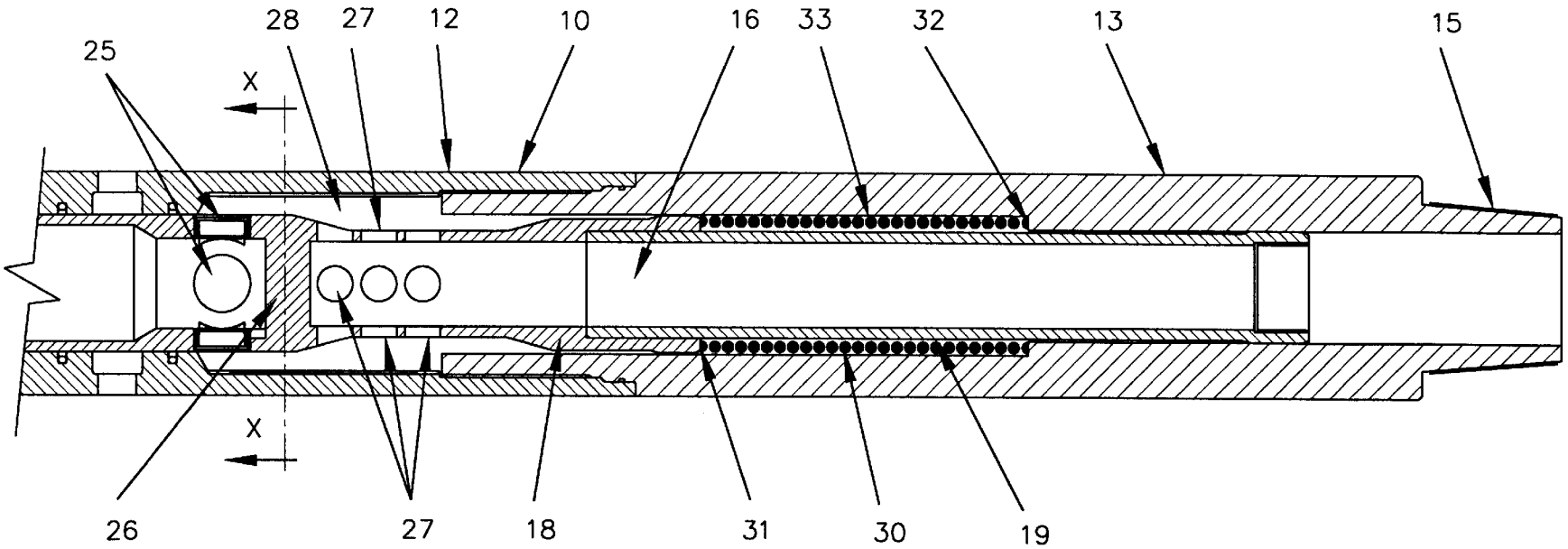
Figure 4:
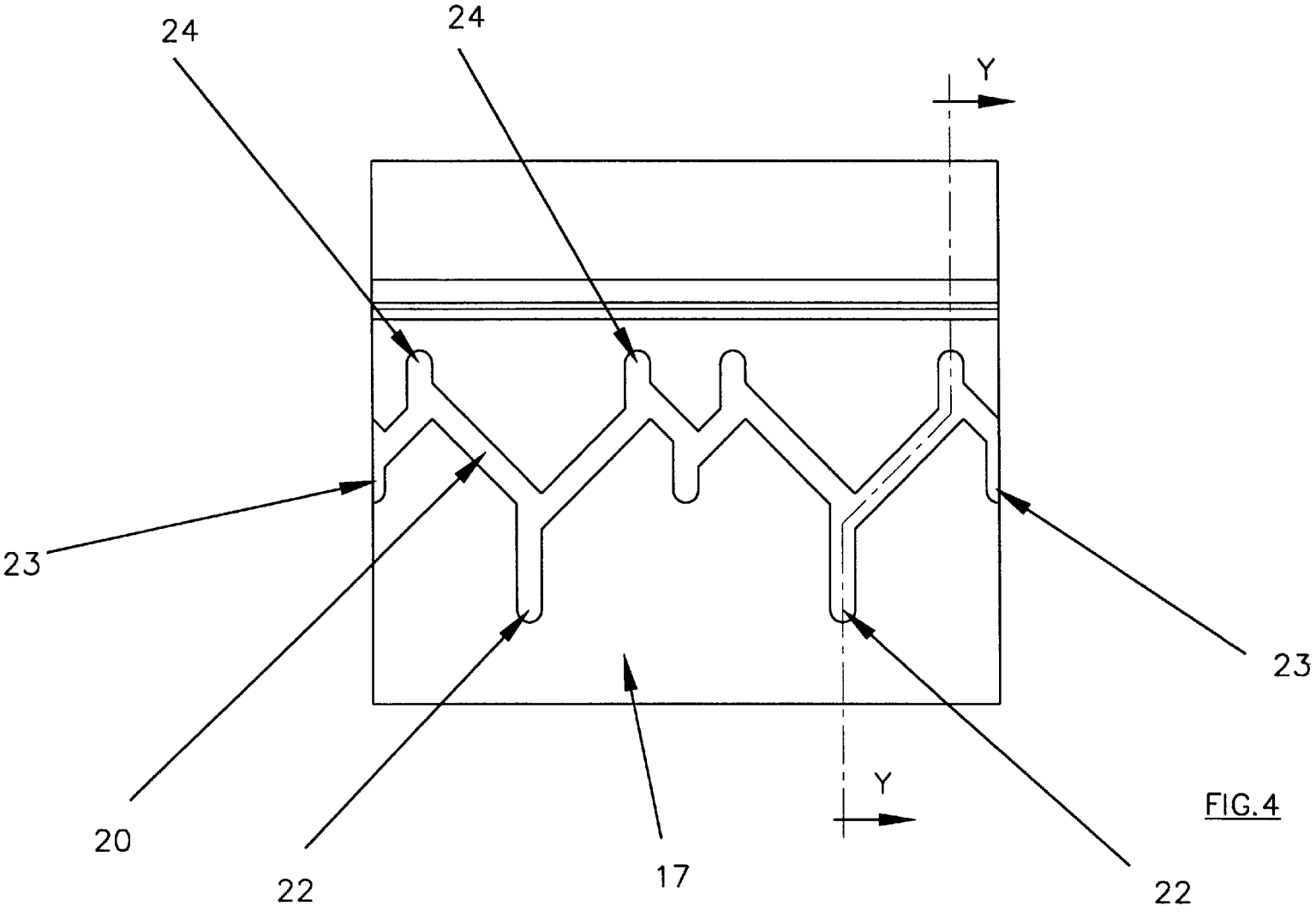
FIG. 4 is a developed view of the camming groove of the spool and showing at Y—Y the line of section of FIGS. 1 to 3.

The camming component 17 has a cam groove 20 formed therein, the 360° developed profile of which is shown in FIG. 4. A pair of diametrically opposed pins 21 are mounted in upstream component 11 of the body and engage in the cam groove 20, to cause the spool to perform a defined motion with respect to the body upon axial reciprocation of the spool. The profile is such that the rotation of the spool will be uni-directional and when moved nearer the downstream end of the tool, the pins will be located in portions 22 or 23 of the groove 20, corresponding to the positions illustrated in FIGS. 1 and 2 respectively. Conversely, each time the spool is moved towards the upstream end of the tool, the pins will be located in a diametrically opposed pair of portions 24 of the groove.

The valving component 18 of the spool has four equi-spaced orifices 25 and, immediately downstream thereof, a internal dividing wall 26. Downstream of that wall, there are nine flow re-entry apertures 27. The central component 12 of the body defines a chamber 28, with which the orifices 25 and apertures 27 communicate, when the spool 16 is in the position illustrated in FIG. 1—that is, with the pins 21 in portions 22 of camming groove 20.

Figure 2:
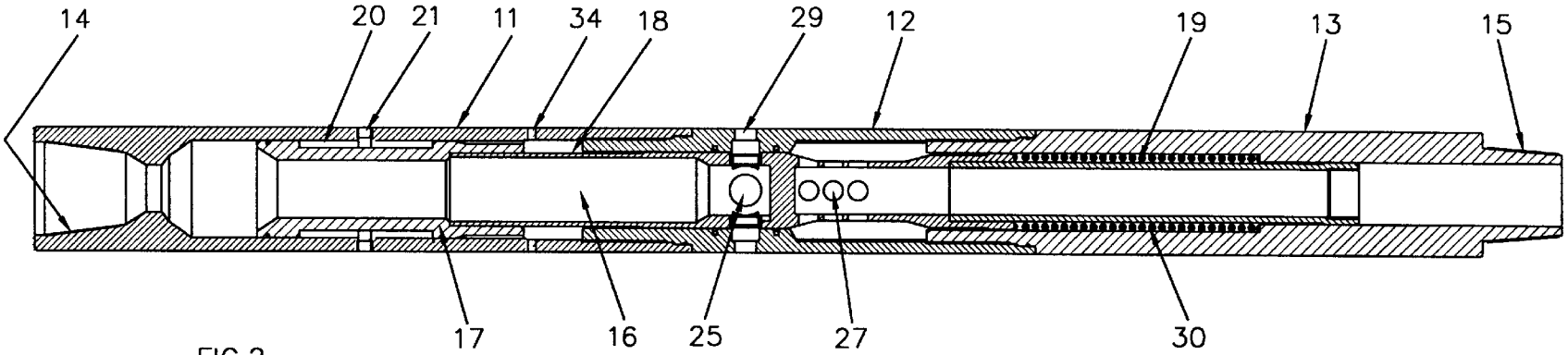
FIG. 2 is a sectional view, on a reduced scale, through the tool but in a circulating (first) pre-set position.

The central component 12 of the body also defines four openings 29, with which the orifices 25 register when the spool 16 is in the position illustrated in FIG. 2—that is, with the pins 21 in portions 23 of camming groove 20. Here, the dividing wall 26 prevents flow towards the downstream end of the tool.

Figure 3:
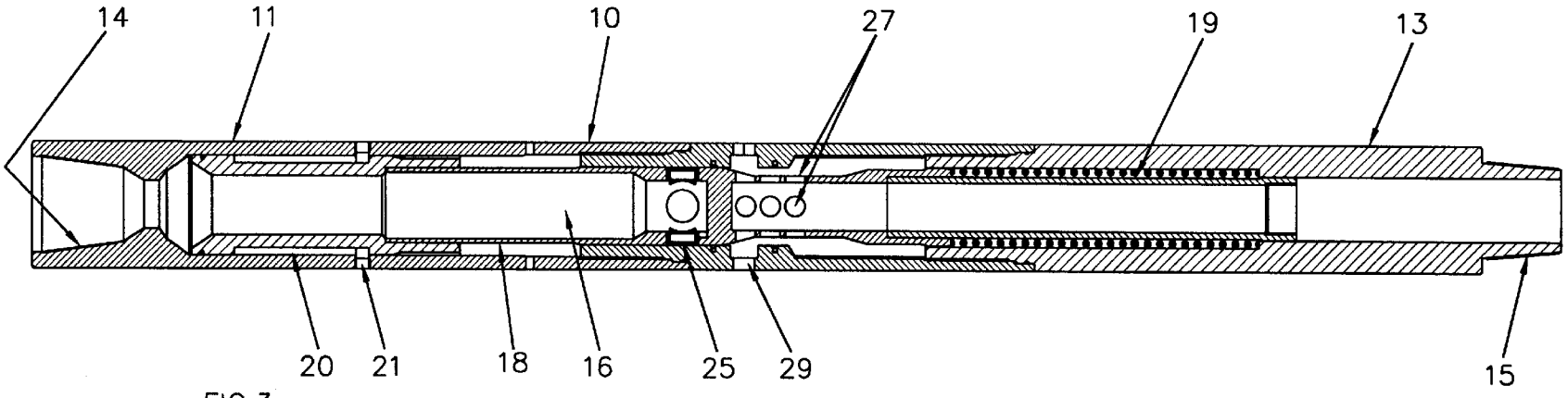
FIG. 3 is a sectional view through the tool in a non-pressured position.

A compression spring 33 is located in annular space 30, between the downstream component 13 of the body and downstream component 19 of the spool. That spring could be a helical spring or a disc spring and acts between the downstream end face 31 of the valving component 18 and a shoulder 32 of downstream component 13 of the body, so urging the spool towards the upstream end of the tool, to the position illustrated in FIG. 3—that is, with the pins 21 in portions 24 of camming groove 20.

The upstream component 11 of the body has four pressure relieving bores 34 communicating with a space downstream of the camming component 17. This ensures that the pressure below the camming component is that prevailing externally of the tool which always will be less than the pressure at the upstream end of the tool, within the string whenever fluid is being pumped along the string.

In use, the tool is fitted into a string so that the body 10 forms a part thereof. Initially, the spool 16 is in the position illustrated in FIG. 3, by virtue of the action of the compression spring 33. Then, on pumping fluid along the string 33, the differential pressure to which the camming component 17 is subjected will move the spool 16 axially downstream. Depending upon which portions 24 of the camming groove 20 were located the pins 21, the spool will then move axially until the pins 21 are located in portion 22 (so allowing flow axially through the tool) or in portions 23 (so allowing circulation of fluid, out of the tool). Each time a change of state is required, the pressure of the pumped fluid is relieved, so allowing the spool 16 to move under the action of the compression spring back to its FIG. 3 position and then on pumping fluid once more, the spool will move to its other pre-set position.

The tool may be operated an indefinite number of times to change the circulation state, merely by relieving the pressure of the pumped fluid and then restoring that pressure. Provided that the pumped pressure is above the minimum required to move the spool against the action of the compression spring, the change of state will occur. Moreover, the surface pump pressure will indicate whether there has been a change of state, as there will be increased pump pressure due to increased frictional losses if the mud is circulating through the telemetry system and the mud motor. For cased-hole liner clean-out operations, the increased pump pressure would be as a result of the reduced bore of the liner clean-out drill string.

In addition to the advantages noted above, the use of a tool of this invention allows use of an increased mud flow rate during circulating operations, so reducing the mud circulation time and increasing the displacement and removal efficiency of the cuttings. There is also an increased motor life, should these higher flow rates be employed, since not all the mud has to pass through the motor.

A further advantage of having a tool of this invention located upstream of a drill motor and MWD (telemetry) unit is that the tool may isolate the motor and MWD unit from damage when using lost circulation material (LCM) to spot an area where losses are occurring. In turn this increases the life and reliability of the motor and MWD unit.

An alternative use for the tool is in a coiled tubing application employing downhole motors. While coiled tubing is being run into a hole, it is necessary to circulate fluid (typically nitrogen) through the tubing. As coiled tubing does not possess significant collapse resistance, the differential pressure between the well bore and the coiled tubing must be minimised by increasing the pressure within the tubing. This can be achieved by percolating fluid out of the end of the tubing, to ensure the pressure at the end of the tubing approximately matches the well bore pressure.

If a downhole motor is connected to the end of the coiled tubing, it is highly desirable that the fluid flow bypasses the motor whilst the percolation is in a progress. This is because the process of running the tubing can take many hours, which would otherwise reduce the useful motor life. The tool of this invention may thus be installed upstream of the motor, in order that circulation may be through the tool, so by-passing the motor and conserving the motor life.

We claim:

1. A flow control tool for incorporation in an underground string, comprising an elongate hollow outer body having first and second axial ends, a hollow inner spool mounted within the outer body and movable both axially and rotationally with respect thereto, motion control means arranged between the body and the spool to effect rotation of the spool relative to the body sequentially through a plurality of pre-set angularly spaced positions upon axial reciprocation of the spool, at least one spool orifice extending through a side wall thereof and which comes into communication with an opening through the body at a first pre-set position of the spool and is out of communication at a second pre-set position, an internal dividing wall within the spool downstream of the at least one spool orifice, at least one flow re-entry aperture leading to the interior of the spool downstream of said wall, an internal chamber within the body and with which both the at least one spool orifice and the at least one re-entry aperture communicate when the spool is in the second pre-set position whereby fluid flow may be essentially axially through the tool, spring means urging the spool in the axial direction opposed to the pumped fluid flow direction to a third pre-set position where flow through the spool is closed off, and the spool being arranged such that fluid under pressure and flowing axially therethrough moves the spool axially against the action of the spring.

2. A flow control tool as claimed in claim 1, wherein flow passages are provided to permit partial flow through the tool and partial outward flow through a communicating spool orifice and body opening, when the spool is set to the first pre-set position.

3. A flow control tool as claimed in claim 1, wherein the motion control means comprises a cam surface on one of the spool and the body, and a cam follower on the other of the spool and the body.

4. A flow control tool as claimed in claim 3, wherein the cam surface comprises a camming groove formed in a cylindrical surface of one of the spool and body.

5. A flow control tool as claimed in claim 4, wherein the cam follower comprises a pin mounted on a cylindrical surface of the other of the spool and body and confronting said surface in which is formed the camming groove.

6. A flow control tool as claimed in claim 4, wherein the camming groove defines at least one first and one second pre-set positions spaced both axially and angularly from each other.

7. A flow control tool is claimed in claim 4, wherein the camming groove defines two first and two second pre-set positions arranged alternately.

8. A flow control tool as claimed in claim 4, wherein there are four equi-spaced spool orifices and four corresponding body openings.

9. A flow control tool as claimed in claim 1, wherein the motion control means is arranged to effect uni-directional rotation of the spool with respect to the body upon reciprocation of the spool.

10. A flow control tool as claimed in claim 1, wherein the or each spool orifice comes into and out of direct registration with a respective body opening by axial displacement of the spool between its first and second pre-set positions.

11. A flow control tool as claimed in claim 1, wherein the two axial ends of the hollow body are provided with string couplers, whereby the body may form a part of a string.

12. A flow control tool as claimed in claim 1, wherein an annular chamber is formed between the body and the spool downstream of the at least one spool orifice, which chamber is provided with pressure-relieving bores whereby the spool may move against the force of the spring solely under the influence of sufficient applied fluid pressure.

13. A flow control tool for incorporation in an underground string, comprising an elongate hollow outer body, a hollow inner spool mounted within the outer body and movable both axially and rotationally with respect thereto, motion control means arranged between the body and the spool to effect rotation of the spool relative to the body sequentially through a plurality of pre-set angularly spaced positions upon axial reciprocation of the spool, at least one spool orifice extending through a side wall thereof and which comes into communication with said opening at a second pre-set position, an internal dividing wall downstream of the at least one orifice therein, the spool and body together defining a chamber therebetween downstream of the body opening and with which chamber the at least one spool orifice communicates when the spool is in its second pre-set position so that fluid flowing axially into the body leaves the spool through the at least one spool orifice to flow into the chamber and from there flows axially along the tool to the downstream end thereof, spring means urging the spool in the axial direction opposed to the pumped fluid flow direction, and the spool being arranged such that fluid under pressure and flowing axially therethrough moves the spool axially against the action of the spring.

14. A flow control tool as claimed in claim 13, wherein the motion control means comprises a cam surface on one of the spool and the body, and a cam follower on the other of the spool and the body.

15. A flow control tool as claimed in claim 10, wherein the cam surface comprises a camming groove formed in a cylindrical surface of one of the spool and body, and the cam follower comprises a pin mounted on a cylindrical surface of the other of the spool and body and confronting said surface in which is formed the camming groove.

16. A flow control tool as claimed in claim 15, wherein the camming groove defines two first and two second pre-set positions arranged alternately and space both axially and angularly from each other.

17. A flow control tool as claimed in claim 16, wherein the motion control means is arranged to effect unidirectional rotational of the spool with respect to the body upon reciprocation of the spool.

18. A flow control tool as claimed in claim 13, wherein an annular chamber is formed between the body and the spool downstream of the at least one spool orifice, which chamber is provided with pressure-relieving bores whereby the spool may move against the force of the spring solely under the influence of sufficient applied fluid pressure.

* * * * *